US010605427B1

(12) United States Patent
Chen et al.

(10) Patent No.: US 10,605,427 B1
(45) Date of Patent: Mar. 31, 2020

(54) LIGHT SOURCE MODULE AND ILLUMINATION DEVICE COMPRISING THE SAME

(71) Applicant: Xuan Fan Electro-optical Technology Co., Ltd., New Taipei (TW)

(72) Inventors: Jian-Lun Chen, New Taipei (TW); Ming-Teng Kuo, New Taipei (TW); Po-Heng Lai, New Taipei (TW)

(73) Assignee: Xuan Fan Electro-optical Technology Co., Ltd., New Taipei (TW)

( * ) Notice: Subject to any disclaimer, the term of this patent is extended or adjusted under 35 U.S.C. 154(b) by 0 days.

(21) Appl. No.: 16/170,004

(22) Filed: Oct. 24, 2018

(51) Int. Cl.

| | |
|---|---|
| ***F21S 41/00*** | (2018.01) |
| ***F21S 41/663*** | (2018.01) |
| ***F21V 29/70*** | (2015.01) |
| ***F21S 41/147*** | (2018.01) |
| ***F21S 41/43*** | (2018.01) |
| ***F21V 5/04*** | (2006.01) |

(52) U.S. Cl.
CPC ..... *F21S 41/663* (2018.01); *F21S 41/147* (2018.01); *F21S 41/43* (2018.01); *F21V 5/04* (2013.01); *F21V 29/70* (2015.01)

(58) Field of Classification Search
CPC ..... F21S 41/40; F21S 41/663; F21S 41/67; F21S 41/43; F21S 41/141; F21S 41/143; F21S 41/147; F21S 41/148; F21S 41/151; F21S 41/153
See application file for complete search history.

(56) References Cited

U.S. PATENT DOCUMENTS

2004/0136202 A1* 7/2004 Ishida ..... F21S 41/143 362/545
2015/0308649 A1* 10/2015 Chen ..... F21S 41/43 362/516
2017/0299137 A1* 10/2017 Kinoshita ..... F21S 41/147

* cited by examiner

*Primary Examiner* — Y M. Lee
(74) *Attorney, Agent, or Firm* — Anna Tsang

(57) ABSTRACT

The invention provides a vehicle lamp which includes a lens, a lighting module, and a mask. The lens includes an optical axis. The lighting module includes a first LED lighting source which includes a first substrate to dispose a plurality of LEDs on the first substrate and includes a first lighting projection direction parallel to the optical axis for emitting a first light beam through the lens to a projection plane. The mask is located between the lens and the first lighting source, and includes an edge for partially shading the first light beam to form a cutting line between a light area and a dark area on the projection plane. The first LED lighting source is adjacent to the mask in a distance less than 5 mm.

11 Claims, 5 Drawing Sheets

LIGHT SOURCE MODULE AND ILLUMINATION DEVICE COMPRISING THE SAME

BACKGROUND OF THE INVENTION

Field of Invention

The present invention generally relates to a light source module and an illumination device comprising the same, and especially to a light source module and a vehicle head lamp device comprising the same.

Description of Related Art

The light source modules used in vehicle lamps, especially in vehicle head lamps, are an important part in the modern vehicles. Generally speaking, the vehicle lamps include head lamps, brake lamps, tail lamps, and etc. which are all standard parts in the modern vehicles for vehicle illumination purpose. Especially, the head lamp is used in a front lighting system in motor vehicles, which is mainly used at night or in tough and harsh environments for road lighting.

In conventional vehicle headlights, halogen lamps or discharge lamps, such as HID lamps (High Intensity Discharge, HID), are commonly used as the front light source module. However, halogen lamps or HID lamps have a short lifetime, such as only several hundred or several thousand hours. If head lamps have a short lifetime, they needs to be exchanged frequently and usually results in some problems, such as high cost and inconvenience, and etc. Therefore, seeking a new durable light source with longer lifetime to replace conventional headlamps for better performance is a need for current vehicle technology and market. A new light source with long duration lifetime for the light source modules or vehicle lamps is welcome and important for future vehicle technology and market.

A LED (Light Emitting Diode, LED) light source is a new type of solid-state light source in the lighting technology, especially in the vehicle lighting technology. Compared to conventional halogen or HID bulb, a LED light source has a longer lifetime, smaller size and lower power consumption. Currently, LED has been considered to use in some vehicle lighting systems. And several designs for new LED front lighting system have also been considered to use in new vehicle vehicles.

However, the optical, the thermal and the electrical designs of those new LED light sources are totally different from those of the traditional vehicle lamps. As to the current vehicle lighting systems with conventional vehicle head lamps, it is difficult to directly replace the halogen or HID lamp with the above-mentioned new LED light source. Car makers have to resolve this problem or reconsider different design rules for LED headlamps during developing new motor vehicles. Therefore, a new vehicle lamp design for LED bulb is important. There is a strong need for the existing motor vehicles to develop new proper LED headlamps

SUMMARY OF THE INVENTION

The present invention develops a new LED light source module and provides different design rules to directly replace the conventional halogen or HID lamps for resolving prior problems and overcoming prior disadvantages in the related prior art of a vehicle front lighting systems. Furthermore, the present invention provides a light source module and a vehicle illumination device, which is compatible with the conventional front lighting system and can directly replace the conventional halogen or HID lamps under the original housing and electrical architectures of the aftermarket headlights.

The present invention provides a vehicle lamp with a LED lighting source being adjacent to a mask in a predetermined distance, especially in a very small distance less than 5 mm, wherein the mask is an original unit in conventional lamp housing and electrical architectures of the aftermarket headlights.

In one perspective, the present invention provides a vehicle lamp including: a lens, a lighting module, and a mask. The lens includes an optical axis. The lighting module includes a first LED lighting source which includes a first substrate to dispose a plurality of LEDs on the first substrate and includes a first lighting projection direction parallel to the optical axis for emitting a first light beam through the lens to a projection plane. The mask is located between the lens and the first lighting source, and includes an edge for partially shading the first light beam to form a cutting line between a light area and a dark area on the projection plane. The first LED lighting source is adjacent to the mask in a distance less than 5 mm.

In one embodiment, the lens further includes a focal zone, which contacts the edge, wherein the focal zone is defined by an allowable range of the focus point of the lens.

In one embodiment, the distance between the first LED light source and the mask is between 1 mm and 5 mm. In one preferable embodiment, the distance is preferred to be between 1 mm and 3 mm.

In one embodiment, the vehicle lamp further includes a reflector, which includes a reflection surface inside the reflector. The lighting module further includes a second LED lighting source, correspondingly located to the reflection surface, for emitting a second light beam which is projected to and reflected by the reflection surface, partially shaded by the mask, and through the lens to the projection plane.

In one embodiment, the illumination intensity of the first light beam on the projection plane is not less than the illumination intensity of the second light beam.

In one embodiment, the second LED lighting source is located on a second substrate and includes a second lighting projection direction which is not parallel to the first lighting projection direction for emitting the second light beam projected to and reflected by the reflection surface.

In one embodiment, the LEDs on the first substrate are located in a forward light area, and optional includes a right side light area or a left side light area.

In one embodiment, the LEDs are in a same size to be located on the first substrate in an array. In one embodiment, the array comprises a linear shape, an L shape, a U shape, an H shape, an M shape, an N shape, or a combination of at least two thereof.

The objectives, technical details, features, and effects of the present invention will be better understood with regard to the detailed description of the embodiments below, with reference to the drawings.

DESCRIPTION OF THE PREFERRED EMBODIMENTS

The drawings as referred to throughout the description of the present invention are for illustrative purpose only, to show the interrelations between the components, but not drawn according to actual scale.

Figure 1A:
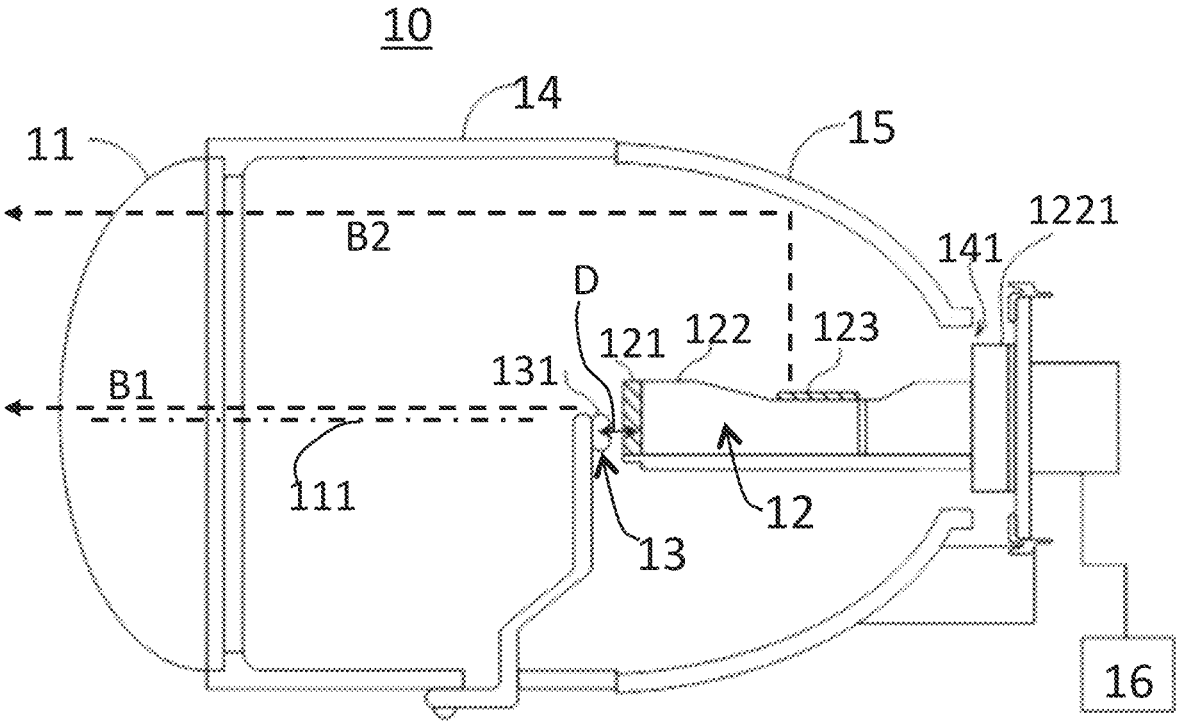
FIG. 1A shows a vehicle illumination device according to one embodiment of the present invention.

FIG. 1A shows a vehicle illumination device 10 according to one embodiment of the present invention. The vehicle illumination device 10 may be used in a front lighting system for a motor vehicle; especially, used in an aftermarket vehicle headlight system. The vehicle illumination device 10 of the present invention is mainly designed and used to replace the conventional vehicle headlights, such as, halogen lamps or HID lamps in the existing motor vehicles. The vehicle illumination device 10 includes a lens 11, a light source module 12, a mask 13, a housing module 14, a reflector 15 and a circuit module 16. For being compatible with a conventional front lighting system, such as a projector type headlight structure, the vehicle illumination device 10 comprises several conventional components: for example, the projection lens 11, the mask 13, and the reflector 15. The projection lens 11 includes an optical axis 111. The reflector 15 comprises, for example, a spheroidal mirror for reflecting a portion of the light emitted upward from the light source module 12 forward and passing through the mask 13 and the projection lens 11. The mask 13 and the projection lens 11 are coupled to the reflector 15. The projection lens 11, the mask 13, and the reflector 15 are all assembled on the housing module 14. The housing module 14 has an opening 141 for fixing the light source module 12 by coupling a supporting base 1221. The mask 13 is arranged on the optical axis 111 between the light source module 12 and the projection lens 11. The circuit module 16 electrically connects the light source module 12 for turning on or turning off the light source module 12.

As shown in FIG. 1A, the light source module 12 comprises a holder 122, a first LED lighting source 121, and an optional second LED lighting source 123. The first LED lighting source 121 includes a plurality of LEDs on a substrate (for example, as shown in FIGS. 4A, 4B, 4C, and 4D, a plurality of LEDs are disposed on the substrate S). The first LED lighting source 121 emits a first light beam B1 in a direction parallel to the optical axis 111 via the mask 13 and through the lens 11 to generate a cut-off line on a projection plane P (as shown in FIG. 3).

Furthermore, as shown in FIG. 1A, the mask 13 is located between the lens 11 and the first lighting source 121 and near the focus point of the projection lens 11. The projection lens 11 is a convex lens and the optical axis 111 of the projection lens 11 is arranged to be aligned with an optical axis of the light source module 12. The mask 13 includes an edge 131 for partially shading the first light beam B1 to form a cut-off line L between a light area A1 and a dark area Ad on the projection plane P (as shown in FIG. 3). The first LED lighting source 121 is adjacent to the mask 13. For example, The first LED lighting source 121 approaches to the mask 13 in a distance D less than 5 mm, for example, preferred a distance D between 1~3 mm.

As shown in FIG. 1A, in one embodiment, the lens 11 includes a focal zone, which contacts the edge 131, wherein the focal zone is defined by an allowable range of the focus point of the lens 11. The edge 131 of the mask 13 is located within the focal zone for obtaining a clear cutting line L (FIG. 3) between the light area A1 and the dark area Ad. On the contrary, when the edge 131 of the mask 13 is not located within the focal zone, the cutting line L may be blurred so that the boundary between the light area A1 and the dark area Ad is not clearly defined.

Figure 3:
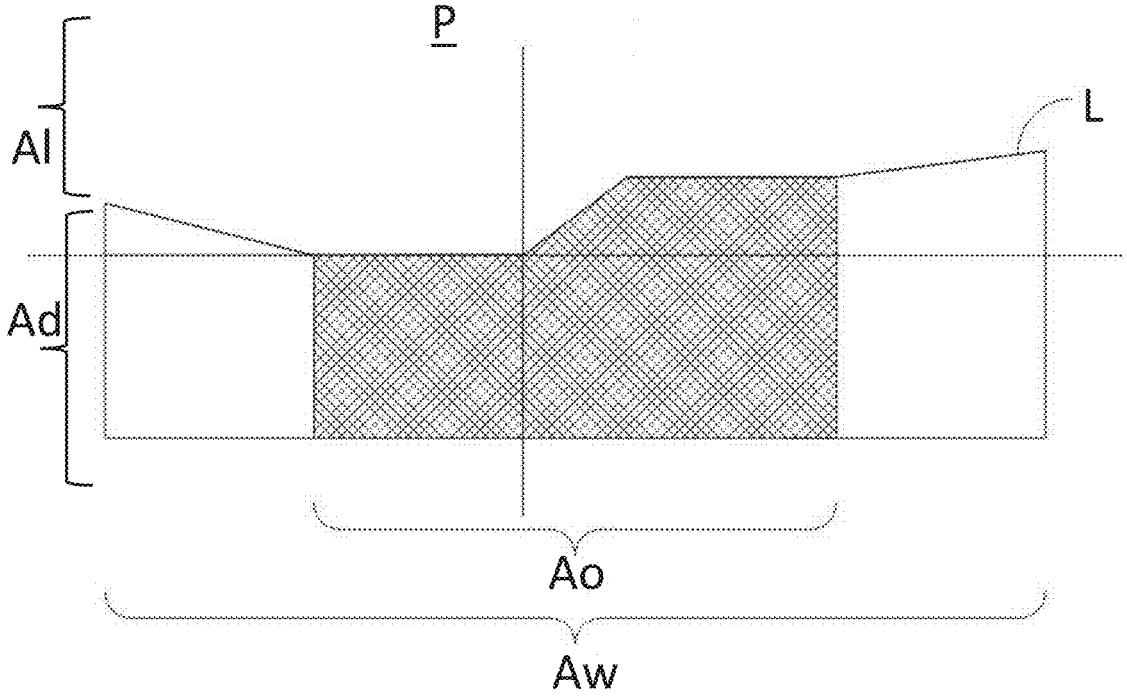
FIG. 3 shows a light distribution on a projection plane complying with the automobile requirement of ECE R112 (Economic Commission of Europe, Regulations R112, Motor Vehicle Headlamps Emitting an Asymmetrical Passing Beam or a Driving Beam or Both and Equipped with Filament Lamps and/or LED Modules) according to FIGS. 1A-1B and 2A-2B of the present invention.

As shown in FIG. 1A, in one embodiment, the first LED lighting source 121 can be adjacent to the mask 13 as closely as possible to generate a good illumination distribution on the projection plane P (FIG. 3). In one aspect, the distance D between the first LED light source 121 and the mask 13 is between 1 mm and 5 mm, and preferred between 1 mm and 3 mm, such that this distance range can generate a good illumination distribution on the projection plane P (FIG. 3). In one aspect, the first LED lighting source 121 can even be adjacent to the mask 13 directly. However, the design of the distance can be not limited to these embodiments. That is, the distance can be decided according to practical need.

Different from the prior front lighting system, the first LED lighting source 121 of the present invention emits the first light beam B1 which is emitted directly forward along the optical axis 111 of the projection lens 11. Then, the first light beam B1 of the first LED lighting source 121 could be partially cut by the mask 13 and partially pass over the mask 13 and finally converge through the projection lens 11 to form a regulatory light distribution and the target luminous intensity distribution on a projection plan P (FIG. 3) in a distance of 25 m ahead of the vehicle illumination device 10 as required by Regulations of Headlamps with an Asymmetrical Passing Beam No. ECE R112 (Economic Commission of Europe, Regulations R112, Motor Vehicle Headlamps Emitting an Asymmetrical Passing Beam or a Driving Beam or Both and Equipped with Filament Lamps and/or LED Modules), as shown in FIG. 3, for example. In addition, the light distribution offered by the vehicle illumination device 10 of the present invention would be arranged to meet the luminous intensity distribution as aforementioned.

As shown in FIG. 1A, the vehicle illumination device 10 further includes an optional second LED lighting source 123, which is fixed to one side, especially an upper side, of the holder 122 for emitting a second light beam B2 upward and then substantially forward after being reflected by the reflector 15 and passing through the mask 13 and the projection lens 11. Since the first LED lighting source 121 is arranged very near the mask 13 and emits the first light beam B1 forward and passing over the mask 13 directly, the first light beam B1 may form a brighter light distribution with a clear cut-off line on the projection plane P (FIG. 3). Moreover, the second light beam B2 emitted from the second LED lighting source 123 is reflected by the reflector 15, the second light beam B2 may form a wider light distribution than the light distribution contributed by the first light beam B1 on the projection plane P. That is, the luminance area of the first LED light beam B1 on the projection plane would be smaller than that of the second LED light beam B2; meanwhile, the luminance of the first light beam B1 on the projection plane would be no less than or even brighter that of the second light beam B2. In another word, the illuminance of the central portion of the light distribution on the projection plane P is mainly supplied by the first LED lighting source 121 while that of the side portions of the light distribution is substantially contributed by the second LED lighting source 123.

Figure 1B:
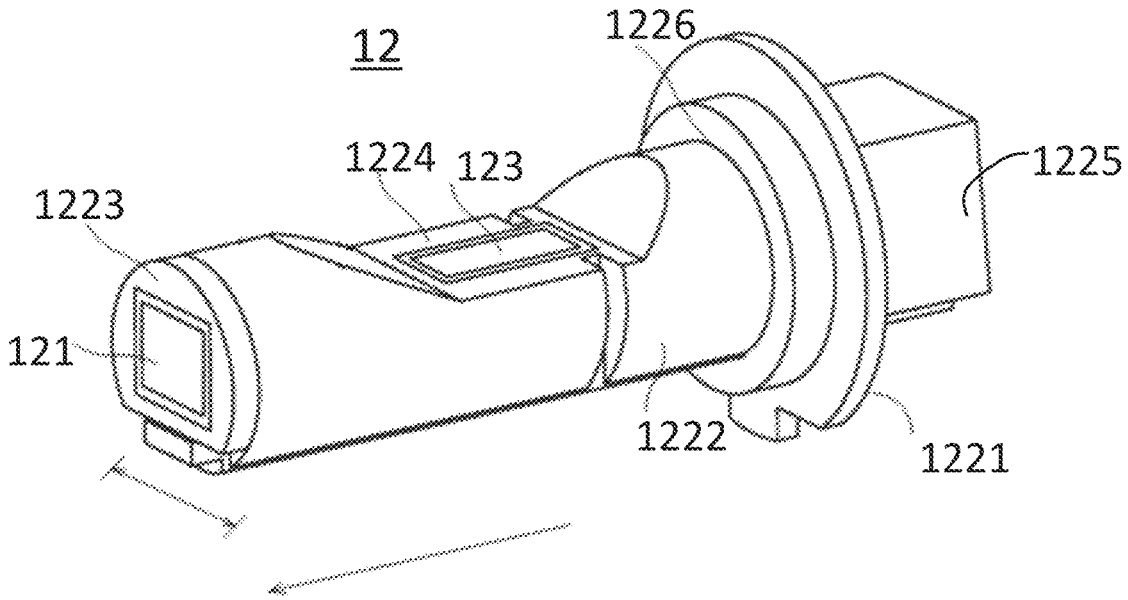
FIG. 1B shows a light source module assembled in the vehicle illumination device as FIG. 1A of the present invention.

FIG. 1B shows detailed components of the light source module 12 assembled in the vehicle illumination device 10 as FIG. 1A of the present invention. The light source module 12 of the present invention is designed to be compatible with the existing front lighting system so the light source module 12 can be easily detachably fastened to the reflector 15 of the vehicle illumination device 10. The holder 122 is used to carry these two LED lighting sources 121, 123 and to dissipate the heat generated by the two LED lighting sources 121, 123. The holder 122 comprises a supporting base 1221 and a main body 1222. The main body 1222 is, for example, a column with two ends and at least one side between the two ends. Specifically, the main body 1222 comprises a front end 1223, an upper side 1224, and a back end 1225, as illustrated in FIG. 1B. The supporting base 1221 comprises coupling unit 1226 arranged near the back end 1225 so that the supporting base 1221 may be detachably coupled to the reflector 15. Moreover, the coupling unit 1226 would be adjustably positioned along the main body 1222 for properly locating the first and the second LED lighting sources 121, 123 corresponding to the mask 13 to provide proper light distribution. Accordingly, the light source module 12 assembled in the vehicle illumination device 10 of the present invention would be flexibly adapted to different types of the conventional headlamps.

Figure 2A:
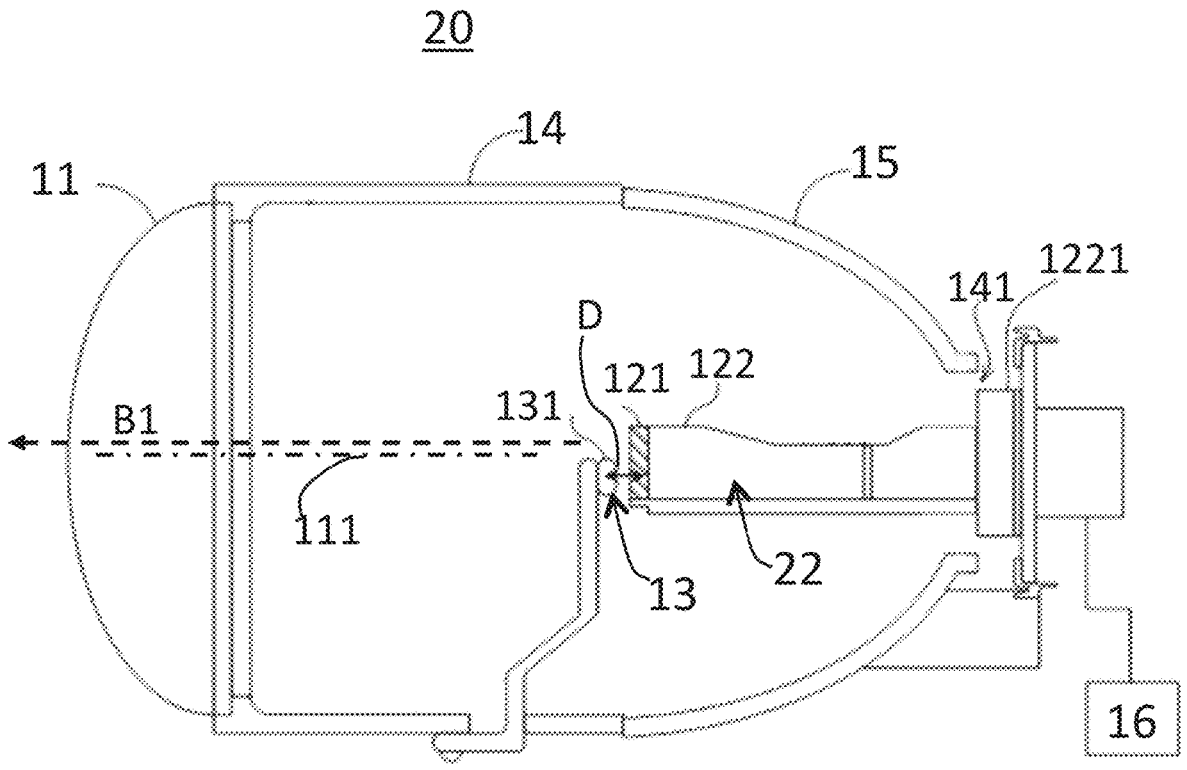
FIG. 2A shows a vehicle illumination device according to another embodiment of the present invention.
Figure 2B:
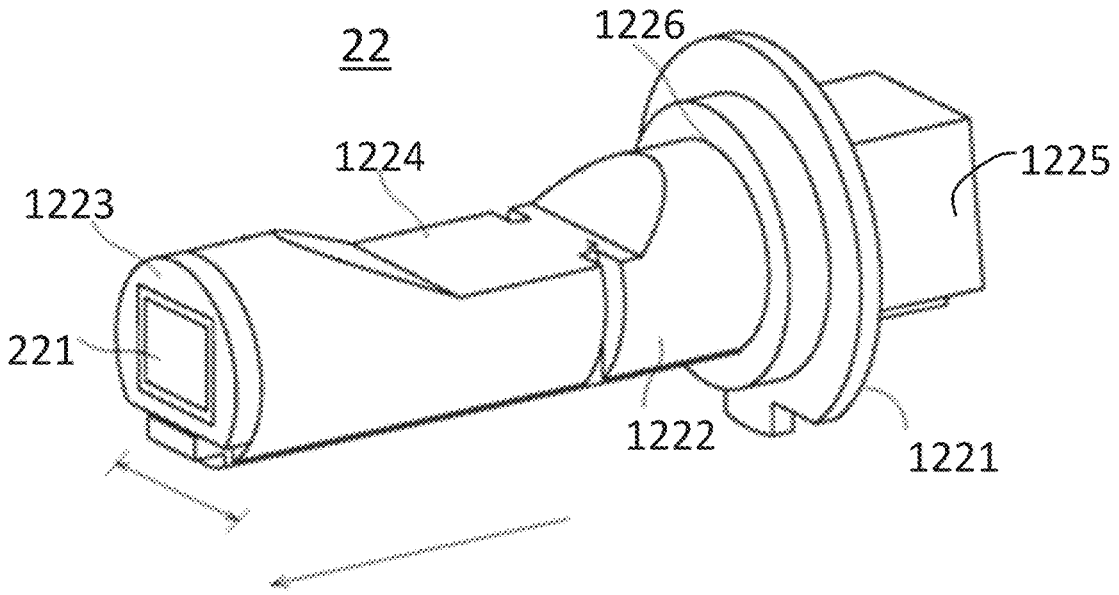
FIG. 2B shows a light source module assembled in the vehicle illumination device as FIG. 2A of the present invention.

FIG. 2A shows a vehicle illumination device 20 according to another embodiment of the present invention. FIG. 2B shows a light source module assembled in the vehicle illumination device as FIG. 2A of the present invention. Hereinafter, the same constituent elements as those of embodiment of FIGS. 1A and 1B will be denoted by the same reference numerals. The vehicle illumination device 20 includes a lens 11, a light source module 12, a mask 13, a housing module 14, a reflector 15 and a circuit module 16. The projection lens 11 includes an optical axis 111. The reflector 15 comprises, for example, a spheroidal mirror for reflecting a portion of the light emitted upward from the light source module 12 forward and passing through the mask 13 and the projection lens 11. The mask 13 and the projection lens 11 are coupled to the reflector 15. The projection lens 11, the mask 13, and the reflector 15 are all assembled on the housing module 14. The housing module 14 has an opening 141 for fixing the light source module 12 by coupling a supporting base 1221. The mask 13 is arranged on the optical axis 111 between the light source module 12 and the projection lens 11. The circuit module 16 electrically connects the light source module 22 for turning on or turning off the light source module 22.

As shown in FIG. 2A, the light source module 22 comprises a holder 122 and a LED lighting source 221. The LED lighting source 221 includes a plurality of LEDs on a substrate (for example, as shown in FIGS. 4A, 4B, 4C, and 4D, a plurality of LEDs are disposed on the substrate S). The LED lighting source 221 emits a light beam B1 in a direction parallel to the optical axis 111 via the mask 13 and through the lens 11 to generate a cut-off line L on a projection plane P (as shown in FIG. 3).

As shown in FIG. 2B, the light source module 22 of the present invention is designed to be compatible with the existing front lighting system so the light source module 22 can be easily detachably fastened to the reflector 15 of the vehicle illumination device 20. The holder 122 is used to carry the LED lighting source 221 and to dissipate the heat generated by the LED lighting source 221. The holder 122 comprises a supporting base 1221 and a main body 1222. The main body 1222 is, for example, a column with two ends and at least one side between the two ends. Specifically, the main body 1222 comprises a front end 1223, an upper side 1224, and a back end 1225, as illustrated in FIG. 2B. The supporting base 1221 comprises coupling unit 1226 arranged near the back end 1225 so that the supporting base 1221 may be detachably coupled to the reflector 15. Moreover, the coupling unit 1226 would be adjustably positioned along the main body 1222 for properly locating the LED lighting sources 221 corresponding to the mask 13 to provide proper light distribution. Accordingly, the light source module 22 assembled in the vehicle illumination device 20 of the present invention would be flexibly adapted to different types of the conventional headlamps.

FIG. 3 shows a light distribution and on a projection plane complying with the automobile requirement of ECE R112 according to FIG. 1A-1B or 2A-2B of the present invention. According to FIGS. 2A-2B, the LED lighting sources 221 emits the light beam B1 in a direction parallel to the optical axis 111 via the mask 13 and through the lens 11 to generate a cut-off line L between the light area A1 and the dark area Ad on a projection plane P. The light beam B1 of the LED lighting source 221 could be partially cut by the mask 13 and partially pass over the mask 13, and finally converge through the projection lens 11 to form a regulatory light distribution as required by ECE R112 (Economic Commission of Europe, Regulations R112, Motor Vehicle Headlamps Emitting an Asymmetrical Passing Beam or a Driving Beam or Both and Equipped with Filament Lamps and/or LED Modules) on a projection plan P in a distance of 25 m ahead of the vehicle illumination device 20.

As shown in FIG. 3, and referring to FIGS. 1A-1B, the first light beam B1 of the first LED lighting source 121 could be partially cut by the mask 13 and partially pass over the mask 13, and finally converge through the projection lens 11 to form a first projection area Ao on the projection plan P in a distance of 25 m ahead of the vehicle illumination device 10. And, the second light beam B2 of the second LED lighting source 123 could also be partially cut by the mask 13 and pass over the mask 13, and finally converge through the projection lens 11 to form a second projection area Aw on the projection plan P in a distance of 25 m ahead of the vehicle illumination device 10. As shown in FIG. 1A, the light path of the second light beam B2 from the second LED lighting source 222 to the lens 11, is longer than the light path of the first light beam B1 from the first LED lighting source 121 to the lens 11. Since a longer light path can provide a wider illumination coverage area, the second projection area Aw is wider and larger than the first projection area Ao on the projection plane P, and the first projection area Ao overlaps the second projection area Aw to form the overlapping area Ao. And, the first light beam B1 of the first LED lighting source 121 emits on the projection plan P directly, while the second light beam B2 of the second LED lighting source 123 reflects from the reflector 15 and then emits on the projection plan P indirectly. Therefore, the illumination intensity of the first light beam B1 is not less than the illumination intensity of the second light beam B2 on the projection plane P. In addition, because of different illumination coverage area sizes on the projection plane P, when an illumination power emitted from the first LED lighting source 121 is same as an illumination power emitted from the second LED lighting source 123, the illumination intensity of the first light beam B1 is larger than the illumination intensity of the second light beam B2 on the projection plane P.

Figure 4A:
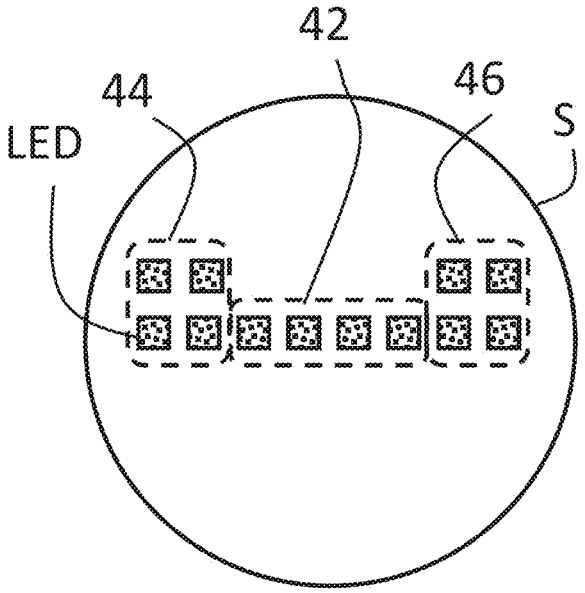
FIGS. 4A, 4B, 4C, and 4D show various LED arrays on the substrate according to multiple embodiments of the present invention.

FIGS. 4A, 4B, 4C, and 4D show various LED arrays on the substrate S according to multiple embodiments of the present invention. At first, as shown in FIG. 4A, in one embodiment, the LEDs on the substrate S are located in a symmetrical way, including a central lighting area 42 and peripheral lighting areas, such as a right peripheral lighting area 44 and a left peripheral lighting area 46. For example, the LEDs on the central lighting area 42 are main forward lighting sources of the light beam B1 to be projected on the projection plane P, and the LEDs on the first peripheral lighting area 44 and the second peripheral lighting area 46 are peripheral lighting sources of the light beam B1 for strengthening the illumination strength on the right and left sides of the light area A1.

Figure 4B:
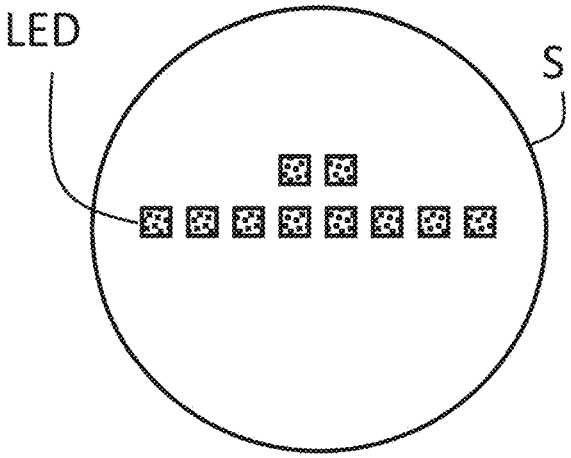
Figure 4C:
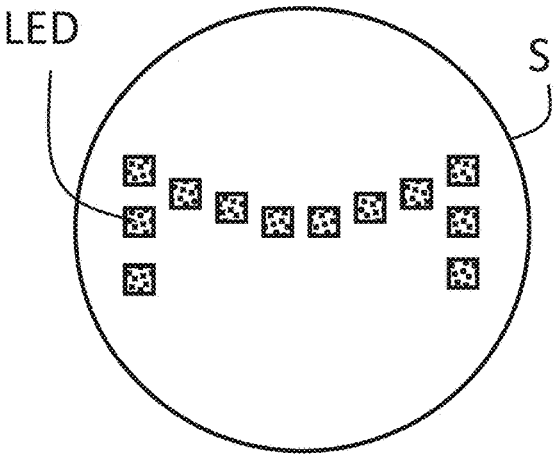
Figure 4D:
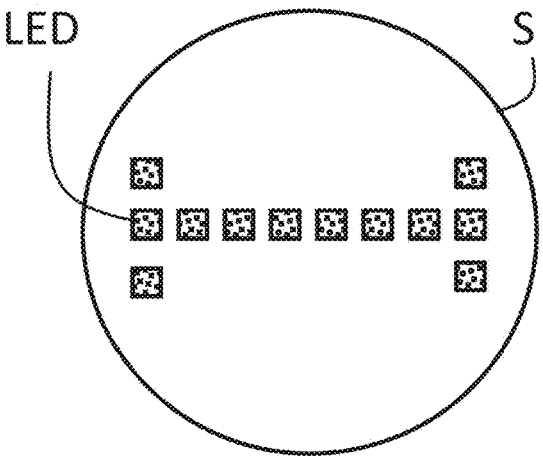

Please further refer to FIGS. 4B, 4C, and 4D, the LEDs are in a same size to be located on the substrate S in a symmetrical array, wherein the substrate S can be the first substrate or the second substrate. As shown in FIGs, in various embodiments, the array includes a plurality of shapes, such as a "⊥" shape (FIG. 4B), an M shape (FIG. 4C), an H shape (FIG. 4D), a linear shape, a U shape, or a combination of at least two thereof. As known in the art, other patterns by rearranging those chips or adding additional LED chips around the aforesaid shape can also provide sufficient illuminance distribution.

Figure 5:
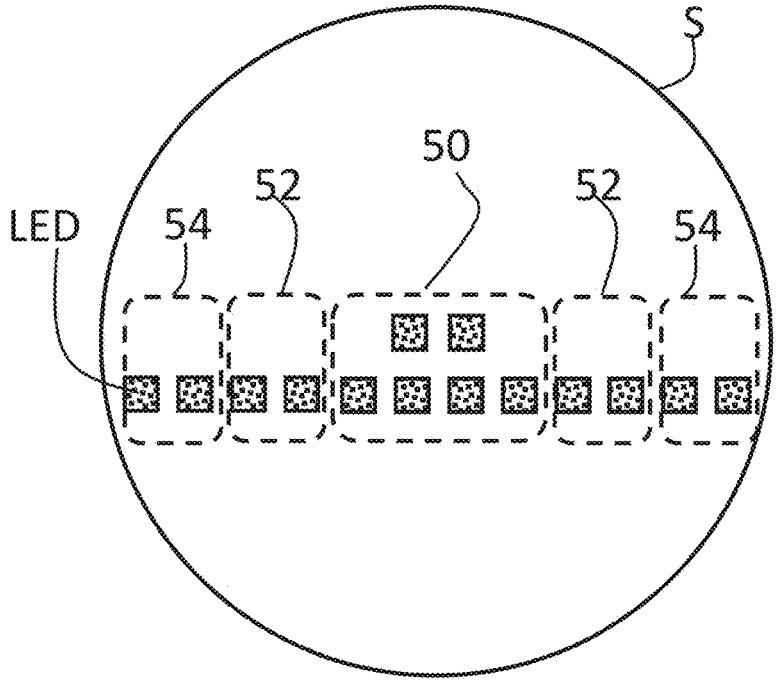
FIG. 5 shows an LED array on the substrate according to one embodiment of the present invention.
Figure 6:
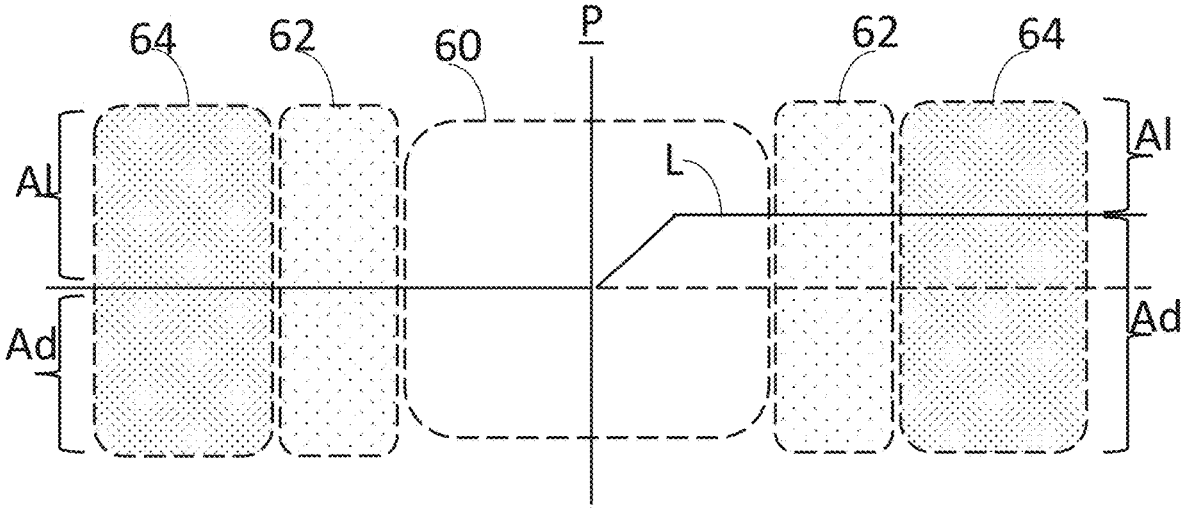
FIG. 6 shows a light distribution on a projection plane complying with the automobile requirement of ECE R112 (Economic Commission of Europe, Regulations R112, Motor Vehicle Headlamps Emitting an Asymmetrical Passing Beam or a Driving Beam or Both and Equipped with Filament Lamps and/or LED Modules), corresponding to FIG. 5 of the present invention.

Furthermore, please refer to FIGS. 5 and 6. FIG. 5 shows an LED array on the substrate according to one embodiment of the present invention. FIG. 6 shows a light distribution on a projection plane complying with the automobile requirement of ECE R112 corresponding to FIG. 5 of the present invention. As shown in FIG. 6, the LEDs on the substrate S are located in a symmetrical way and can be separated into plurality of lighting areas, including a central lighting area 50, first peripheral lighting areas 52 and second peripheral lighting areas 54. For example, the LEDs on the central lighting area 50 are main forward lighting sources of the light beam B1 to be projected on a central projection area 60 of the projection plane P, the LEDs on the first peripheral lighting areas 52 and the second peripheral lighting areas 54 are peripheral lighting sources of the light beam B1, wherein the LEDs on the first peripheral lighting areas 52 are first peripheral lighting sources of the light beam B1 to be projected on first peripheral projection areas 62 of the projection plane P, and the LEDs on the second peripheral lighting areas 54 are second peripheral lighting sources of the light beam B1 to be projected on second peripheral projection areas 64 of the projection plane P. The first peripheral lighting sources and the second peripheral lighting sources are used for strengthening the illumination strength on peripheral area of the light area A1 to form an emission shape and a brightness distribution for the specific light distribution as required by vehicle regulation.

Further, in order to be compatible in the existing vehicle headlights, the illumination module of the present invention should be compatible with the original space limitations. Thus, the width of the light source module 12 or the supporting base 1221 should be compatible with the dimension of the opening 141 of the housing module 14 and by the regulation requirement. If the width thereof is too wide, the light source module 12 or the supporting base 1221 would fail to be plugged into the housing module 14 via the opening 141. On the other hand, if the width is not wide enough, the light distribution provided by the first LED lighting source 121 would probably fail to meet the regulation requirement. Both considering the space limitation of all conventional headlight and the regulation requirement. For example, the LED chips of the first LED lighting source 121 are arranged to form a linear light source with an effective horizontal length within 6~18 mm on the substrate S. That is, the maximum width of the light source module 12 could be within 6~18 mm as well accordingly.

In the preferred embodiment of the present invention, the substrate S would be made of heat conductive materials comprising, such as, silicon, AlN, Al2O3, aluminum, copper, or the like. Moreover, for improving the integration of the LED package and accurately controlling the conversion rate of the phosphor, the mounting process of the substrate S and the LED array 42, 44, 46, 50, 52, 54, and the coating or printing process of covering a fluorescent layer thereon would be integrated in one LED package process.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention; for example, there may be additional devices inserted between two devices shown to be in direct connection in the embodiments, as long as such inserted devices do not affect the primary function of the circuitry. Besides, an embodiment or a claim of the present invention does not need to attain or include all the objectives, advantages or features described in the above. The abstract and the title are provided for assisting searches and not to be read as limitations to the scope of the present invention. It is not limited for each of the embodiments described hereinbefore to be used alone; under the spirit of the present invention, two or more of the embodiments described hereinbefore can be used in combination. For example, two or more of the embodiments can be used together, or, a part of one embodiment can be used to replace a corresponding part of another embodiment.

What is claimed is:

1. A light source module, assembled in a vehicle illumination device having a mask and a reflector, comprising:

a holder, having a front end and at least one side; and a first LED lighting source with a plurality of LEDs, being set on the front end of the holder for emitting a first light beam directly forward to generate a cut-off line on a projection plane via the mask, wherein the LEDs are separated into plurality of lighting areas by including a central lighting area, a first peripheral lighting area and a second peripheral lighting area, wherein the first peripheral lighting area and the second peripheral lighting area are used for strengthening the illumination strength on peripheral area of a light area on the projection plane;

wherein the first LED lighting source is adjacent to the mask.

2. The light source module according to claim 1, further comprising an optional second LED light source, being set on the at least one side of the holder, for emitting a second light beam substantially forward via the reflector and the mask.

3. The light source module according to claim 2, wherein the luminance of the first light beam on the projection plane is no less than that of the second light beam.

4. The light source module according to claim 1, wherein the first LED lighting source is adjacent to the mask in a distance less than 5 mm.

5. The light source module according to claim 4, wherein the first LED lighting source is adjacent to the mask in a distance within 1~3 mm.

6. The light source module according to claim 1, wherein the plurality of LEDs of the first LED light source are in a same size and arranged in an array.

7. The light source module according to claim 6, wherein the array comprises a linear shape, an L shape, a U shape, an H shape, an M shape, an N shape, an I shape, or a combination of at least two thereof.

8. A vehicle illumination device, comprising:

a lens, including an optical axis;

a light source module, comprising:

a holder, having a front end and at least one side; and a first LED lighting source with a plurality of LEDs, which is separated into plurality of lighting areas by including a central lighting area, a first peripheral lighting area and a second peripheral lighting area, being set on the front end of the holder for emitting a first light beam directly forward in a first lighting projection direction parallel to the optical axis of the lens; and a mask, located between the lens and the first lighting source, and including an edge for partially shading the first light beam to form a cut-off line between a light area and a dark area on the projection plane, wherein the first peripheral lighting area and the second peripheral lighting area are used for strengthening the illumination strength on peripheral area of the light area on the projection plane;

wherein the first LED lighting source is adjacent to the mask.

9. The vehicle illumination device according to claim 8, wherein the lens includes a focal zone, which contacts the edge of the mask, wherein the first LED lighting source is set within the focal zone.

10. The vehicle illumination device according to claim 8, further comprising a reflector, which includes a reflection surface.

11. The vehicle illumination device according to claim 10, wherein the lighting module further includes an optional second LED lighting source, correspondingly located on the side of the holder, for emitting a second light beam which is projected to and reflected by the reflection surface of the reflector, partially shaded by the mask, and through the lens to the projection plane, and the illumination intensity of the first light beam on the projection plane is not less than the illumination intensity of the second light beam.

* * * * *